US007059906B2

(12) United States Patent
Kato et al.

(10) Patent No.: US 7,059,906 B2
(45) Date of Patent: Jun. 13, 2006

(54) ELECTRICAL CONNECTOR FOR LAPTOP COMPUTER

(75) Inventors: Hiromichi Kato, Tokyo (JP); Takuya Higeta, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/066,742

(22) Filed: Feb. 25, 2005

(65) Prior Publication Data

US 2005/0191905 A1 Sep. 1, 2005

(30) Foreign Application Priority Data

Feb. 27, 2004 (JP) ..... 2004-052705

(51) Int. Cl.
*H01R 13/648* (2006.01)

(52) U.S. Cl. ..... 439/607

(58) Field of Classification Search ..... 439/607, 439/610, 579, 497

See application file for complete search history.

(56) References Cited

U.S. PATENT DOCUMENTS

| | | | | |
|---|---|---|---|---|
| 5,941,725 | A * | 8/1999 | Brennan et al. | 439/357 |
| 6,123,582 | A * | 9/2000 | Ko et al. | 439/579 |
| 6,439,926 | B1 * | 8/2002 | Kuan | 439/607 |
| 6,676,444 | B1 * | 1/2004 | Noro | 439/579 |
| 6,705,893 | B1 * | 3/2004 | Ko | 439/607 |

* cited by examiner

*Primary Examiner*—Michael C. Zarroli
(74) *Attorney, Agent, or Firm*—Abelman, Frayne & Schwab

(57) ABSTRACT

An electrical connector includes a plurality of contacts 16, a housing 12 for holding and fixing the contacts 16 therein and having a fitting portion 24 with which a mating object is fitted, and two shells 20 and 22 covering the housing 12. One shell 20 of the two shells comprises at a predetermined position with respect to its longitudinal direction a required number of substantially L-shaped engagement portion 23 integrally formed on the one shell 20. With this construction, even with an electrical connector of miniaturization of height of less than 2 mm, it is possible to provide a connector 10 whose shells 20 and 22 are prevented from being deformed due to undue forces accidentally acting upon the coaxial cables 14.

6 Claims, 2 Drawing Sheets

36
38
40
38
22
10
36
40
141
163
24
26
35
34
28
34
141
163
161
16
142
32
26
14
144
143
35
28
32
18
12
14
144
36
23
23
36
20

ELECTRICAL CONNECTOR FOR LAPTOP COMPUTER

BACKGROUND OF THE INVENTION

The present invention relates to an electrical connector for use with notebook personal computers, small type digital appliances and the like, and more particularly to a connector having a construction for preventing shells from being deformed.

In general, a hitherto used electrical connector mainly comprises a housing, a required number of contacts, and shells. The contacts are held and fixed in the housing which has a fitting portion adapted to be fitted with a mating connector. The shells are fixed to the housing so as to cover it.

Japanese Utility Model Application Opened No. H4-92, 384/1992 discloses an electrical connector. As can be seen from the "Abstract" of the Japanese Utility Model Application, metal shells are fixed to an insulating block by fitting anchoring projections formed on the insulating block into anchoring apertures formed in fixing tongues provided on the metal shells for the purpose of preventing the metal shells of a receptacle connector from being deformed when a plug connector is fitted into the receptacle connector. To achieve such a purpose, there are provided means for securing the centers of the metal shells 6 with respect to their longitudinal direction, which are inferior in mechanical strength, to the insulating block, or means for avoiding application of forces causing deformation at the centers of the metal shells 6 with respect to their longitudinal direction when fitting the plug connector into the receptacle connector. In more detail, the Utility Model discloses deformation preventing means, such as (1) engagement of anchoring tongues with anchoring steps or shoulders on the side of fitting portion of the connectors, (2) connection of the shells on the side of the fitting portion of the connectors, (3) insertion of fixing inserting tongues into tong receiving apertures on the side of connection portion, and (4) calking.

Depending upon spaces in appliances and applications and specifications or customer's demands, however, the means described above could not be employed. With an electrical connector of lower geometry or miniaturization of height of less than 2 mm, particularly, the construction described above would be impossible.

SUMMARY OF THE INVENTION

It is an object of the invention to provide an improved electrical connector which overcomes the disadvantages of the prior art described above and which is able to prevent shells from being deformed even with miniaturization of height of less than 2 mm.

The above object can be achieved by the electrical connector 10 including a plurality of contacts 16, a housing 12 for holding and fixing the contacts 16 therein and having a fitting portion 24 with which a mating object is fitted, and two shells 20 and 22 covering the housing 12, wherein one shell 20 comprises at a predetermined position with respect to its longitudinal direction a required number of substantially L-shaped engagement portion 23 integrally formed on the one shell 20 according to the invention.

In a preferred embodiment of the invention, the substantially L-shaped engagement portion 23 is provided on the one shell 20 in the proximity of substantially center with respect to its longitudinal direction. By providing the engagement portion in such a position, the shells 20 and 22 are prevented from being deformed in a well-balanced manner.

In another embodiment of the invention, the substantially L-shaped engagement portion 23 integrally formed on the one shell 20 in the direction of its thickness is brought into engagement with the other shell 22. With such an engagement, the shells are prevented from being deformed.

As can be seen from the above descriptions the electrical connector 10 according to the invention can bring about the following significant effects.

(1) In the electrical connector 10 including a plurality of contacts 16, a housing 12 for holding and fixing the contacts 16 therein and having a fitting portion 24 with which a mating object is fitted, and two shells 20 and 22 covering the housing 12, according to the invention one shell 20 comprises at a predetermined position with respect to its longitudinal direction a required number of substantially L-shaped engagement portion 23 integrally formed on the one shell 20. Therefore, even with an electrical connector miniaturized in height of less than 2 mm, it is possible to provide a connector 10 in a simple construction whose shells 20 and 22 are prevented from being deformed due to undue forces accidentally acting upon coaxial cables 14.

(2) According to the invention, the substantially L-shaped engagement portion 23 is provided on the one shell 20 in the proximity of substantially center with respect to its longitudinal direction. Therefore, the shells 20 and 22 are prevented from being deformed in a well-balanced manner.

(3) According to the invention, the substantially L-shaped engagement portion 23 integrally formed on the one shell 20 in the direction of its thickness is brought into engagement with the other shell 22. As a result, the shells 20 and 22 are prevented from being deformed with great certainty when the coaxial cables 14 are accidentally subjected to undue forces.

The invention will be more fully understood by referring to the following detailed specification and claims taken in connection with the appended drawings.

DESCRIPTION OF THE PREFERRED EMBODIMENTS

Figure 1:
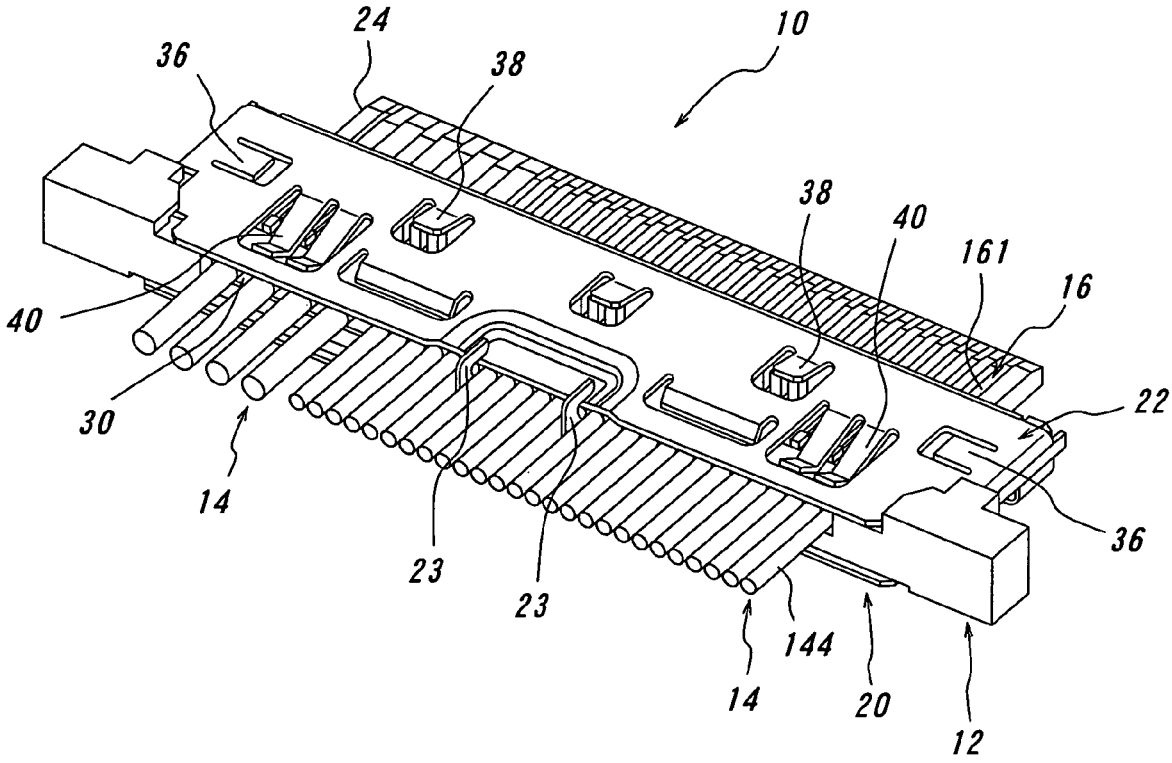
FIG. 1 is a perspective view of an electrical connector according to the invention.
Figure 2:
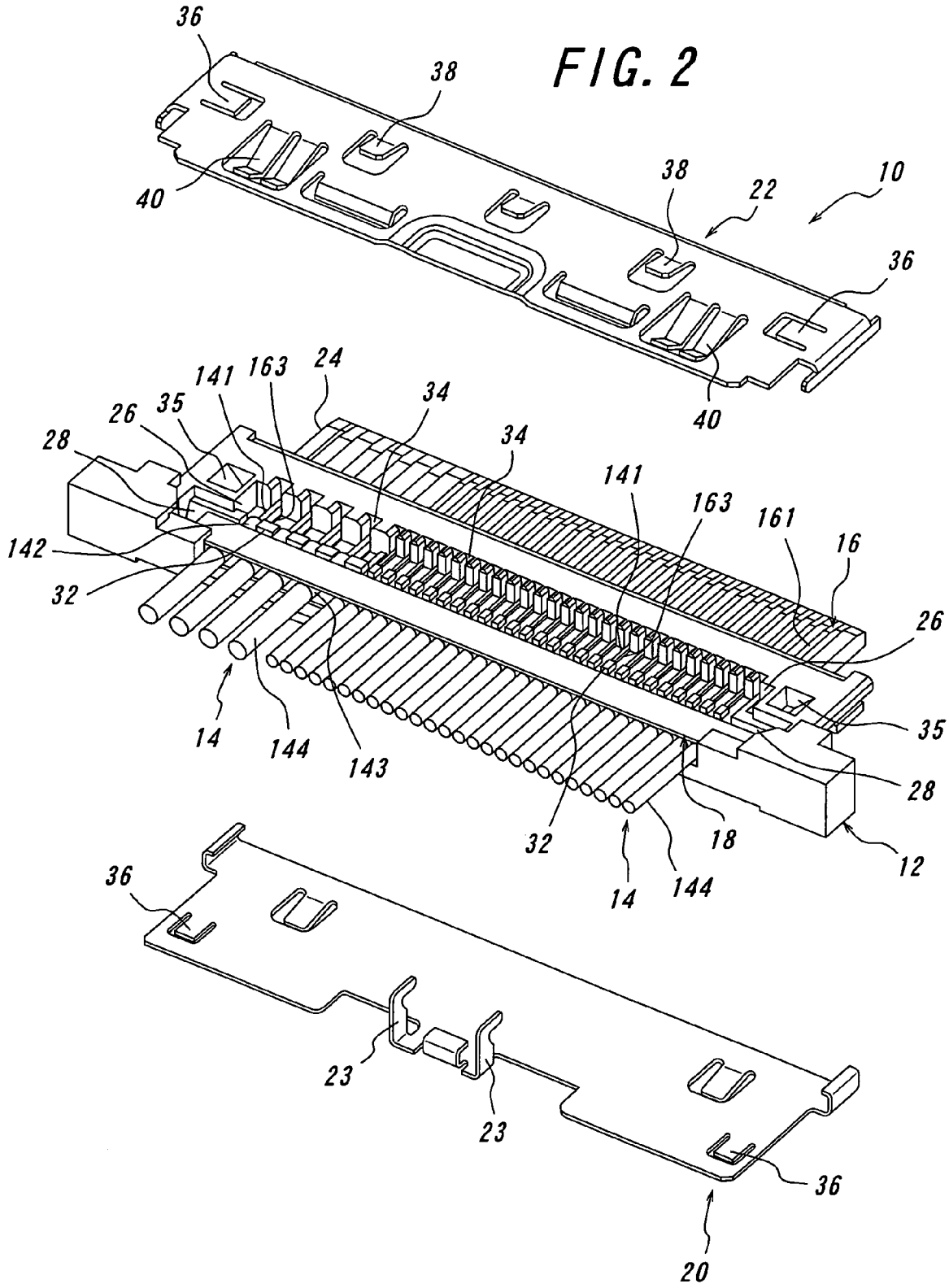
FIG. 2 is a perspective view of the electrical connector shown in FIG. 1 with the two shells separated from the housing of the connector.

An electrical connector 10 of one embodiment according to the invention will be explained with reference to the drawings hereinafter. FIG. 1 is a perspective view of the electrical connector according to the invention. FIG. 2 is a perspective view of the electrical connector according to the invention with two shells separated from each other. The electrical connector 10 according to the invention mainly comprises a housing 12, contacts 16, shells 20 and 22, and a ground bar 18.

Before explaining respective components of the connector, first, the construction of coaxial cables 14 will be explained. The coaxial cables 14 each mainly comprise a center conductor 141, an insulator 142, a braid 143 as an external conductor, and a sheath 144. Note that the details are not shown in the drawing. The center conductor 141 made of a metal is adapted to be connected to the contact 16 and covered by the insulator 142 thereabout. The insulator 142 serves to insulate the center conductor 141 from the braid 143 as an external conductor. The insulator 142 is covered by the braid 143 as the external conductor. The braids 143 are connected to the ground bar 18 to provide the grounding and each covered therearound by the sheath 144 made of an insulating material such as vinyl chloride.

Prior to being connected to the contacts 16, the coaxial cables 14 are pre-treated in the following manner. First, the sheath 144 is removed over a predetermined length, and the leading end of the insulator 142 is then removed to expose the center conductor 141 of a predetermined length. Finally, the braid 143 is partly removed to leave the braid of a predetermined length, while taking care enough to avoid any contact between the center conductor 141 and the braid 143.

The respective components of the connector 10 according to the invention will be explained with reference to the drawings. First, the two shells 20 and 22 will be explained which are the subject features of the invention. As shown in FIG. 2, the two shells 20 and 22 are arranged one above the other. These shells 20 and 22 are made by the publicly known press-working from a metal such as beryllium copper, phosphor bronze, brass and the like to fulfil the requirements imposed thereon, such as dimensional stability, workability and conductivity. The two shells 20 and 22 are substantially U-shaped and fixed to the housing 12 by press-fitting or hooking or latching in a manner covering the housing 12. In the illustrated embodiment, the shells 20 and 22 are each provided with anchoring pieces 36 at longitudinal ends for fixing the shells 20 and 22 to the housing by hooking.

In the illustrated embodiment, the shells may be formed with a required number of mating connector contact pieces 38 and a required number of ground bar contact pieces 40 for the purpose of achieving continuity with the mating connector and providing the grounding with the ground bar 18 depending on specifications or customer's demands. In forming both the contact pieces, the shells 20 and 22 in the working course of them may be formed with slits around the predetermined positions of the contact pieces 38 and 40, leaving part of the slits, and the contact pieces are raised or bent in a cantilevered manner. As a result, the contact pieces 38 and 40 have an elasticity for preferably contacting the mating connector and the ground bar 18.

The shells 20 and 22 and the housing 12 fitted together form an inserting groove 30 on the side of connection portion for inserting a required number of coaxial cables 14. The shell 20, one of the two shells is integrally formed with a plurality of L-shaped engagement portions 23 in order to prevent the shells 20 and 22 from being deformed when the coaxial cables 14 inserted in the inserting groove 30 are unduly subjected to forces accidentally on the side of the inserting groove 30. The L-shaped engagement portions 23 integrally formed on the shell 20 have a free end which engages the main body of the other shell 22 to prevent the deformation of the shells 20 and 22. The number of the engagement portions 23 is suitably designed in consideration of their function, the number of the cables, and the size of the connector. A single engagement portion is of course within the range of the present invention. In the illustrated embodiment of the connector 10 having thirty coaxial cables and of 26 mm in length, 8 mm in width and 1.9 mm in height, the two engagement portions 23 are arranged substantially at the middle of the shell 20 and 3 mm spaced apart from each other.

The size of the shells 20 and 22 may be suitably designed to achieve their function. In the illustrated embodiment, the shell 20 is 22 mm in length, 5.6 mm in width and 0.8 mm in thickness, and the shell 22 is 22.3 mm in length, 5.1 mm in width and 0.9 mm in thickness.

Although the engagement portions 23 are provided on the lower shell 20 as viewed in FIG. 2, it is to be understood that the engagement portions 23 may be provided on either of the shells 20 and 22. Therefore, the engagement portions 23 may be provided on the upper shell 22, which are adapted to engage the lower shell 20.

The housing will then be explained. The housing 12 is made by the publicly known injection molding from an electrically insulating plastic material which is suitably selected in consideration of dimensional stability, workability, manufacturing cost and the like. Preferred materials from which to form the housing 12 include polybutylene terephthalate (PBT), polyamide (66 PA or 46 PA), liquid crystal polymer (LCP), polycarbonate (PC), polyphenylene sulfide (PPS) and the like and combination thereof.

The housing 12 is substantially bar-shaped having a protrusion whose front end forms a fitting portion 24 which extends beyond the shells 20 and 22 for fitting with a mating connector. Contacts 16 are installed in the fitting portion 24 such that contact portions 161 of the contacts 16 are exposed on both the sides of the fitting portion 24. The housing 12 is further formed with inserting holes 34 for inserting a required number of the contacts 16 therein and fixing thereat by press-fitting, hooking (lancing), welding or the like, respectively. Moreover, the housing 12 is formed with anchoring grooves 35 at locations corresponding to the anchoring pieces 36 of the shells 20 and 22 so that the shells 20 and 22 are fixed to the housing 12 by the engagement of the anchoring pieces 36 in the anchoring grooves 35 of the housing 12.

The housing is further provided with a plurality of protrusions 32 in the form of teeth of a comb for arranging the coaxial cables 14 in a row as shown in FIG. 2. The size of the protrusions 32 may be suitably designed in consideration of their function, diameter and pitch of the coaxial cables 14 and the like. In the illustrated embodiment, the protrusions 32 are of the order of 0.3 mm in height, 0.3 mm in width and 0.4 mm in length.

The housing 12 is provided with a mounting portion 26 communicating with the inserting holes 34, and an inserting portion 28 communicating beyond the protrusions 32 with the mounting portion 26. The center conductors 141 of the coaxial cables 14 are connected to connection portions 163 of the contacts 16 in the mounting portion 26, respectively. The inserting portion 28 serves to receive therein the ground bar 18. The size of the inserting portion 28 may be suitably designed in consideration of the size of the ground bar 18 and the strength of the housing, and is approximately 0.1 mm larger than the ground bar 18 in the illustrated embodiment.

The contacts 16 will then be explained. The contacts 16 in the illustrated embodiment include power supply contacts and signal contacts. These contacts are made by the publicly known press-working from a metal such as beryllium copper, low-beryllium copper, phosphor bronze and the like to fulfil the requirements imposed thereon such as conductivity, springiness, dimensional stability and the like. Each of the contacts 16 mainly comprises a contact portion 161 adapted to contact a mating contact, a fixed portion 162 (not seen in the drawing) to be fixed to the housing 12, and a connection portion 163 to be connected to a coaxial cable 14.

Finally, the ground bar 18 will then be explained. The ground bar 18 is made by the publicly known press-working from a metal which may be beryllium copper, low-beryllium copper, phosphor bronze and the like in consideration of conductivity, dimensional stability and the like. The ground bar 18 is substantially a plate-shaped piece and is connected to the braids 143 of coaxial cables 14 by soldering to provide the grounding for the coaxial cables 14. Moreover, the contact pieces 40 of the shell 22 are brought into contact with the ground bar 18 to provide the grounding for the shell 22 and simultaneously for the coaxial cables 14. The ground bar 18 operates to embrace the braids 143 of the coaxial cables 14, thereby providing the grounding for the coaxial cables 14. The size of the ground bar 18 depends upon the number and pitch of the coaxial cables. In the illustrated embodiment with the thirty coaxial cables and 0.5 mm pitch, the ground bar has a length of 19 mm.

The present invention is preferably applicable to connectors for use with notebook personal computers, small type digital appliances and the like. Particularly, the electrical connector 10 according to the invention has a preferable construction for preventing the shells 20 and 22 from being deformed.

While the invention has been particularly shown and described with referenced to the preferred embodiments thereof, it will be understood by those skilled in the art that the foregoing and other changes is form and detail can be made therein without departing from the spirit and scope of the invention.

What is claimed is:

1. An electrical connector including a plurality of contacts, a housing for receiving and retaining said contacts therein and having a fitting portion with which a mating object is fitted, and two shells covering said housing, wherein a first of said two shells comprises at a predetermined position with respect to a longitudinal axis, a plurality of substantially L-shaped engagement portions integrally formed on the first shell, and wherein each of said plurality of substantially L-shaped engagement portions is provided on said first shell proximate the center of the longitudinal axis.

2. The electrical connector as set forth in claim 1, wherein said substantially L-shaped engagement portions are integrally formed on said first shell in the direction of its thickness and are brought into engagement with the other shell.

3. The electrical connector as set forth in claim 1, further comprising a plurality of coaxial cables each cable being connected to one of said plurality of contacts, respectively, and a ground bar for grounding said coaxial cables, and wherein the second shell is provided with at least one ground bar contact piece to contact said ground bar, thereby achieving grounding for the coaxial cables and the second shell through said ground bar.

4. The electrical connector as set forth in claim 3, wherein one of said two shells is provided with at least one mating connector piece to contact a mating connector.

5. The electrical connector as set forth in claim 1 further comprising a plurality of coaxial cables, each cable being connected to one of said plurality of contacts, respectively, and a ground bar for grounding said coaxial cables, and wherein the second shell is provided with at least one ground bar contact piece to contact said ground bar, thereby achieving grounding for the coaxial cables and the second shell through said ground bar.

6. The electrical connector as set forth in claim 2 further comprising a plurality of coaxial cables, each cable being connected to one of said plurality of contacts, respectively, and a ground bar for grounding said coaxial cables, and wherein the second shell is provided with at least one ground bar contact piece to contact said ground bar, thereby achieving grounding for the coaxial cables and the second shell through said ground bar.

* * * * *